US006445108B1

(12) United States Patent
Takeshima et al.

(10) Patent No.: US 6,445,108 B1
(45) Date of Patent: Sep. 3, 2002

(54) PIEZOELECTRIC ACOUSTIC COMPONENT

(75) Inventors: Tetsuo Takeshima, Toyama; Takeshi Kishimoto, Toyama-ken; Muneyuki Daidai, Toyama; Akihiro Nomura, Toyama-ken; Masayuki Fujino, Toyama, all of (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/501,381

(22) Filed: Feb. 9, 2000

(30) Foreign Application Priority Data

Feb. 19, 1999 (JP) ..... 11-40875
Feb. 22, 1999 (JP) ..... 11-42586
Oct. 15, 1999 (JP) ..... 11-293203
Oct. 15, 1999 (JP) ..... 11-293204

(51) Int. Cl.[7] ..... H04R 17/00; H04R 1/00
(52) U.S. Cl. ..... 310/322
(58) Field of Search ..... 310/324, 348, 310/349, 49, 322; H05R 17/00

(56) References Cited

U.S. PATENT DOCUMENTS 3,700,938 A * 10/1972 Bryant ..... 310/324
4,092,463 A * 5/1978 Wurmb et al. ..... 429/105
4,486,742 A * 12/1984 Kudo ..... 310/324
5,770,915 A * 6/1998 Sumita et al. ..... 310/326
5,955,824 A * 9/1999 Saito ..... 310/324
6,313,569 B1 * 11/2001 Sawai et al. ..... 310/320

* cited by examiner

*Primary Examiner*—Nestor Ramirez
*Assistant Examiner*—Karen B Addison
(74) *Attorney, Agent, or Firm*—Keating & Bennett, LLP

(57) ABSTRACT

A piezoelectric acoustic component includes a diaphragm having a substantially rectangular piezoelectric plate including front and back surfaces, an electrode disposed on the front surface, a substantially rectangular metal plate bonded to the back surface of the substantially rectangular piezoelectric plate directly or via an electrode disposed on the back surface of the substantially rectangular piezoelectric plate, an insulating cap having an upper wall, four side walls extending from the upper, a pair of support members arranged to support the diaphragm at the inside of the two of four sides walls opposed to each other, and a plate shaped substrate having a first electrode section and a second electrode section. The diaphragm is disposed the insulating cap. Two of four side edges of the diaphragm are opposed to each other and fixed to the pair of support members. A gap is formed between the other two of four side edges of the diaphragm and the cap and is sealed by elastic sealing material. An acoustic space is provided between the diaphragm and the upper wall of the insulating cap. An opening edge of the four side walls of the insulating cap is bonded to the substrate. The metal plate is electrically connected to the first electrode section. The electrode disposed on the front surface of the substantially rectangular piezoelectric plate is electrically connected to the second electrode section.

20 Claims, 11 Drawing Sheets

PIEZOELECTRIC ACOUSTIC COMPONENT

BACKGROUND OF THE INVENTION

1. Field of the Invention

The present invention relates to piezoelectric acoustic components, such as a piezoelectric buzzer and a piezoelectric earphone.

2. Description of Related Art

Generally, in electronic devices, household-electric-appliances products, portable telephones, or a piezoelectric earphone and other such products, a piezoelectric acoustic component has been widely used as a piezoelectric buzzer or a piezoelectric earphone which generates a warning sound and a sound of operation.

This kind of piezoelectric acoustic component is disclosed in Japanese unexamined patent publication No. 7-107593 and Japanese unexamined patent publication No. 7-203590, for example. The piezoelectric acoustic component has a unimorph type diaphragm including a circular piezoelectric plate and a circular metal plate disposed on an electrode of the circular piezoelectric plate. The circular metal plate of the diaphragm is supported in a circular case at the circumference portion of the circular metal plate, and the opening of the circular case is sealed by a cover.

However, when such diaphragm having such a circular shape is used, problems such as a very low production efficiency and low acoustic conversion efficiency occur. Further, it is difficult to reduce the size of the piezoelectric acoustic component.

The problem of the very low production efficiency will be explained hereinafter.

In a manufacturing process of a piezoelectric acoustic component including the diaphragm having a circular shape, a green sheet 40 is punched by a punching die 41 to produce circular piezoelectric plates 42 as shown in FIG. 1. Next, a circular metal plate 43 is disposed at a electrode on one side of each of the circular piezoelectric plates 42. Then, a diaphragm 44 is obtained by applying a high voltage DC electric field between the electrodes on both sides of the circular piezoelectric plate 42 and polarizing the circular piezoelectric plates 42. The diaphragm 44 is stored in a case 45, and lead wires 46 and 47 respectively connected to the other surface electrode and the metal plate 43 of the piezoelectric board 42 are arranged to extend out of the case 45.

However, when the circular piezoelectric plate 42 is punched from a green sheet 40, as mentioned above, punching sediment increases and the yield of material is very low. Moreover, the process efficiency is very low because the individual processes of electrode formation, polarization, and other steps must be done after the punching process. Furthermore, in order to determine the required size for the design of each element, the punching die 41 of a green sheet must be produced according to the element size. Therefore, the production efficiency is very low and the cost of manufacturing is very high.

The problem with the low acoustic conversion efficiency will be explained hereinafter.

As shown in FIG. 2A, since the diaphragm 44 is supported by a case 45 at the circumference portion thereof, the maximum displacing point P is only at the center portion of the diaphragm 44. Therefore, the displacement volume is small and the acoustic conversion efficiency is low. That is, there is a disadvantage that sound pressure per input energy is comparatively low.

Furthermore, the frequency is high because the circumference portion of the diaphragm is constrained. When producing the piezoelectric diaphragm having a low frequency, there is a disadvantage that the radius size is increased and becomes very large.

SUMMARY OF THE INVENTION

To overcome the above described problems, preferred embodiments of the present invention provide a piezoelectric acoustic component which achieves a high production efficiency, excellent acoustic conversion efficiency and a very small size.

A preferred embodiment of the present invention provides a piezoelectric acoustic component which includes a diaphragm having a substantially rectangular piezoelectric plate including front and back surfaces, an electrode disposed on the front surface of the piezoelectric plate, a substantially rectangular metal plate bonded to the back surface of the rectangular piezoelectric plate directly or via an electrode disposed on the back surface of the rectangular piezoelectric plate, an insulating cap including an upper wall, four side walls extending from the upper wall, a pair of support members arranged to support the diaphragm at the inside of the side walls, a plate shaped substrate having a first electrode section and a second electrode section, the diaphragm being disposed in the insulating cap, two of four side edges of the diaphragm disposed opposite to each other being fixed to the pair of support members, a gap between the other two of the four side edges of the diaphragm and the cap being sealed by elastic sealing material, an acoustic space being provided between the diaphragm and the upper wall of the insulating cap, an opening edge of the four side walls of the insulating cap being bonded to the substrate, the metal plate being electrically connected to the first electrode section, and the electrode disposed on the front surface of the substantially rectangular piezoelectric plate being electrically connected to the second electrode section.

Since the piezoelectric plate has a substantially rectangular shape, even if the piezoelectric plate is produced by punching a green sheet, the generation of punching residue of the green sheet is minimized, and thereby the material efficiency is much improved.

Further, since the process of electrode formation, polarization, and other steps are performed on the parent substrate rather than individual components, production efficiency is very good.

Furthermore, since the required size of the piezoelectric plate is achieved by cutting the parent substrate, it is not necessary to prepare a punching die for punching individual green sheets as is required in the prior art.

In other words, compared with the prior art, the number of steps for punching a green sheet and cutting a parent substrate is greatly reduced and the number of dies, jigs, and types of piezoelectric bodies are reduced, thereby increasing production efficiency and reducing the cost of production.

In preferred embodiments of the present invention, two of four side edges of the diaphragm which are opposite to each other are fixed to the pair of support members, and the gap between the other two of the four side edges of the diaphragm and the cap are sealed by elastic sealing material. When a predetermined frequency signal is input between the metal plate and the electrode disposed on the front surface of the piezoelectric plate, the piezoelectric plate expands, and the diaphragm is deformed in a longitudinal bending mode. In this case, the diaphragm is vibrated so as to generate two nodes at both ends thereof which are fixed to the cap via the support members. As shown in FIG. 2B, a maximum displacement point P exists along the centerline in the longitudinal direction of the diaphragm.

That is, the displacement volume is very large compared with a conventional disc-shaped diaphragm. Since this displacement volume is the energy for moving air, the acoustic conversion efficiency is greatly increased.

According to the above described piezoelectric acoustic component, the gap between the other two of the four side edges of the diaphragm and the cap is preferably sealed by elastic sealing material. Since the elastic sealing material has elasticity, the vibration of the diaphragm is not interfered with, and the sound pressure is not decreased.

Furthermore, since the diaphragm is fixed at the two side edges thereof and the portion between the two side edges is arranged to be displaced freely, the component achieves a lower frequency compared with a conventional disc-shaped diaphragm. Alternatively, the size of the component is reduced when the same frequency is required.

In preferred embodiments of the present invention, the adhesive agent is Preferably one which has a high Young's modulus in the hardened condition, and constrains the edge part of the diaphragm strongly.

Moreover, the elastic sealing material preferably has a low Young's modulus in hardened condition, and the restraint of the diaphragm is weak enough to permit the vibration of the diaphragm. Since there are some elastic sealing materials which have adhesive strength for bonding the diaphragm and the cap, it is possible to use such materials in place of the adhesive agent.

According to the above described piezoelectric acoustic component, the insulating cap which fixes the diaphragm is bonded to the plate shaped substrate, the metal plate is electrically connected to the first electrode section, and the electrode disposed on the front surface of the substantially rectangular piezoelectric plate is electrically connected to the second electrode section. As a result, the piezoelectric acoustic component is completed. In addition, the piezoelectric acoustic component can be constructed as a surface mounting type component by extending the first and second electrode sections to the back-side of the substrate.

Preferably, the piezoelectric plate is disposed on the metal plate in such a way that respective longer edge sides of the piezoelectric plate and the metal plate are aligned to each other and a respective one of the two shorter edge sides of the piezoelectric plate and the metal plate are aligned with each other so that the piezoelectric plate is disposed on the metal plate leaning towards the one shorter edge side of the metal plate at which the metal plate is supported by the support members of the insulating cap. An exposed area is provided around the other shorter edge side of the metal plate and the diaphragm is fixed to the support members of the insulating cap so that the metal plate opposes the upper wall of the insulating cap.

It is possible to fix the diaphragm to the support members of the insulating cap so that the piezoelectric plate opposes the upper wall of the insulating cap, but in this case it is difficult to connect the electrode disposed on the front surface of the piezoelectric plate to the second electrode section of the substrate. On the other hand, when the diaphragm is fixed to the support walls of the insulating cap so that the metal plate opposes the upper wall of the insulating cap, the electrode disposed on the front surface of the piezoelectric plate opposes the substrate. As a result, it is easy to connect the electrode disposed on the front surface of the piezoelectric plate to the second electrode section of the substrate. Further, since the exposed area of the metal plate is exposed around one edge side of the diaphragm, it is easy to connect the metal plate to the first electrode section of the substrate.

Preferably, the metal plate is connected to the first electrode section by electroconductive glue and the electrode disposed on the front surface of the rectangular piezoelectric plate is connected to the second electrode section by electroconductive glue. In this case, the process of bonding the insulating cap to the substrate, the process of electrically connecting the metal plate to the first electrode section and the process of electrically connecting the electrode disposed on the front surface of the piezoelectric plate to the second electrode section can be performed at the same time. Thus, the connecting process is very simple and much less complicated and time consuming than conventional processes.

Preferably, the elastic sealing material includes an insulating material. The elastic sealing material is preferably provided at all of the four side edges of the diaphragm. It is noted that since the metal plate and the electrode disposed on the front surface of the piezoelectric plate are located near each other, they are likely to be short-circuited when connecting the electrode disposed on the front surface of the piezoelectric plate and the second electrode section by the electroconductive glue. If the elastic sealing material is provided in the periphery of the metal plate beforehand, such short-circuit can be prevented. Further, by sealing all of the four side edges of the diaphragm, air leakage is prevented to thereby greatly improve the sound pressure characteristic.

For providing the elastic sealing material at all of the four side edges of the diaphragm, a method of attaching the diaphragm to the insulating cap only by the elastic sealing material (without using adhesive) and a method of providing the elastic sealing material over the two edge sides of the diaphragm which are fixed by adhesive can be used. The latter method is advantageous when it is impossible to prevent air leakage only by the adhesive.

Another preferred embodiment of the present invention provides a piezoelectric acoustic component which preferably includes a diaphragm having a substantially rectangular piezoelectric plate including front and back surfaces, an electrode disposed on the front surface, a substantially rectangular metal plate bonded to the back surface of the rectangular piezoelectric plate directly or via an electrode disposed on the back surface of the substantially rectangular piezoelectric plate, an insulating cap having an upper wall, four side walls extending from the upper wall, and a pair of support members arranged to support the diaphragm at the inside of the two of the four side walls which are opposite each other, a plate shaped substrate having a first electrode section and a second electrode section, the diaphragm being located in the insulating cap, two of the four side edges of the diaphragm opposing each other being fixed to the pair of support members, a gap between the other two of the four side edges of the diaphragm and the cap being sealed by elastic sealing material, an acoustic space being provided between the diaphragm and the upper wall of the insulating cap, an opening edge of the four side walls of the insulating cap being bonded to the substrate, the metal plate being electrically connected to the first electrode section and the electrode disposed on the front surface of the substantially rectangular piezoelectric plate being electrically connected to the second electrode section.

The above described piezoelectric acoustic component also overcomes the problems with conventional devices and methods, as described with respect to the preferred embodiments described above.

According to this piezoelectric acoustic component, the opening of the insulating case in which the diaphragm is contained is sealed by the lid. Further, the metal plate is electrically connected to the first electrode section, and the electrode disposed on the front surface of the substantially rectangular piezoelectric plate is electrically connected to the second electrode section. In addition, the piezoelectric acoustic component can be constructed to provide a surface mounting type by extending the first and second electrode sections to the back-side of the substrate.

In this piezoelectric acoustic component, at least one of the electrode sections for achieving external connections may be an electrode film which is provided on the surface of the insulating case and extends from the support member to the bottom surface of the insulating case. Alternatively, at least one of the electrode sections for external connecting may be a metal terminal which is fixed to the insulating case and extends from the support member to the bottom surface of the insulating case. In this case, the metal terminal may be fixed to the insulating case by bonding, crimping or inserting or other suitable method.

Preferably, the piezoelectric plate is disposed on the metal plate in such a way that respective longer edge sides of the piezoelectric plate and the metal plate are aligned to each other and a respective one of the two shorter edge sides of the piezoelectric plate and the metal plate are aligned with each other so that the piezoelectric plate is disposed on the metal plate leaning towards the one shorter edge side of the metal plate at which the metal plate is supported by the support member of the insulating case. An exposed area is provided around the other shorter edge side of the metal plate and the diaphragm is fixed to the support members of the insulating case so that the metal plate opposes the bottom wall of the insulating cap. Further, it is preferable that the exposed area is connected to the first electrode section and the electrode disposed on the front surface of the substantially rectangular piezoelectric plate is electrically connected to the second electrode section preferably via an electroconductive adhesive agent.

It is possible to fix the diaphragm to the support members of the insulating case so that the piezoelectric plate opposes the bottom wall of the insulating case. But, in this case, since the electrode disposed on the front surface of the piezoelectric plate does not expose to the upper side, it is difficult to connect the electrode disposed on the front surface of the piezoelectric plate to the second electrode section of the substrate.

On the other hand, when the diaphragm is fixed to the support members of the insulating case so that the metal plate opposes the bottom-wall part of the insulating case, the electrode disposed on the front surface of the piezoelectric plate exposes to the upper side, and thereby it is easy to connect the electrode disposed on the front surface of the piezoelectric plate to the second electrode section of the substrate. Further, since the exposed area of the metal plate is exposed around the other edge side of the diaphragm, it is easy to connect the metal plate to the first electrode section of the substrate.

It is noted that the process of connecting the metal plate to the first electrode section of the substrate and the process of fixing the diaphragm to the support members of the insulating case may be performed at the same time. That is, electroconductive adhesive agent may be used when fixing the end of the diaphragm at the side of the exposed area to the support members.

Preferably, the elastic sealing material includes an insulating material and the elastic sealing material is provided at all of the four side edges of the diaphragm. It is noted that since the metal plate and the electrode disposed on the front surface of the piezoelectric plate are located close to each other, they are likely to be short-circuited when connecting the electrode disposed on the front surface of the piezoelectric plate and the second electrode section by electroconductive glue. If the elastic sealing material is provided in the periphery of the metal plate beforehand, such short-circuit can be prevented. Further, by sealing all of the four side edges of the diaphragm, air leakage is prevented to thereby greatly improve the sound pressure characteristic.

For providing the elastic sealing material at all of the four side edges of the diaphragm, a method of attaching the diaphragm to the insulating cap only by the elastic sealing material (without using adhesive) and a method of providing the elastic sealing material over the two edge sides of the diaphragm which are fixed by adhesive can be used. The latter method is advantageous when it is impossible to prevent air leakage only by the adhesive.

Other features and advantages of the present invention will become apparent from the following description of the invention which refers to the accompanying drawings.

DETAILED DESCRIPTION OF PREFERRED EMBODIMENTS

Figure 1A:
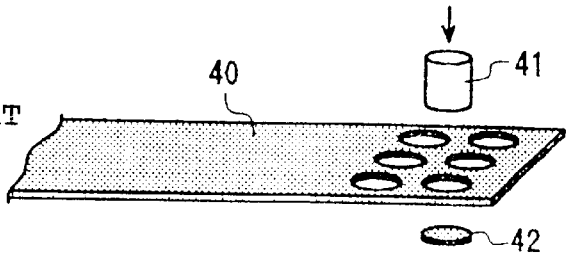
Fig. 1A PRIOR ART
FIGS. 1A, 1B and 1C are views showing the manufacturing process of a prior art piezoelectric buzzer.
Figure 1B:
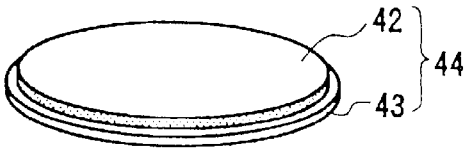
Fig. 1B PRIOR ART
Figure 1C:
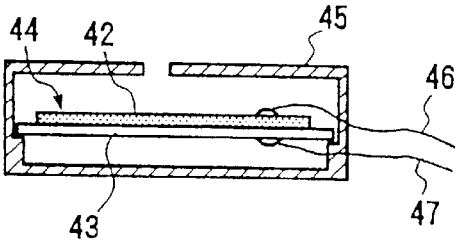
Fig. 1C PRIOR ART
Figure 2A:
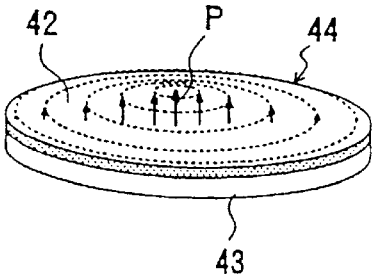
FIGS. 2A and 2B are comparative views showing displacement distributions of a circular shaped diaphragm and a rectangular shaped diaphragm.
Figure 2B:
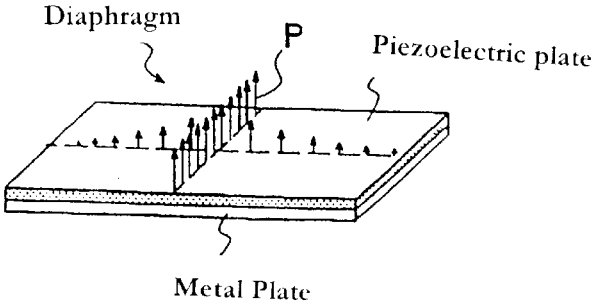
Figure 3:
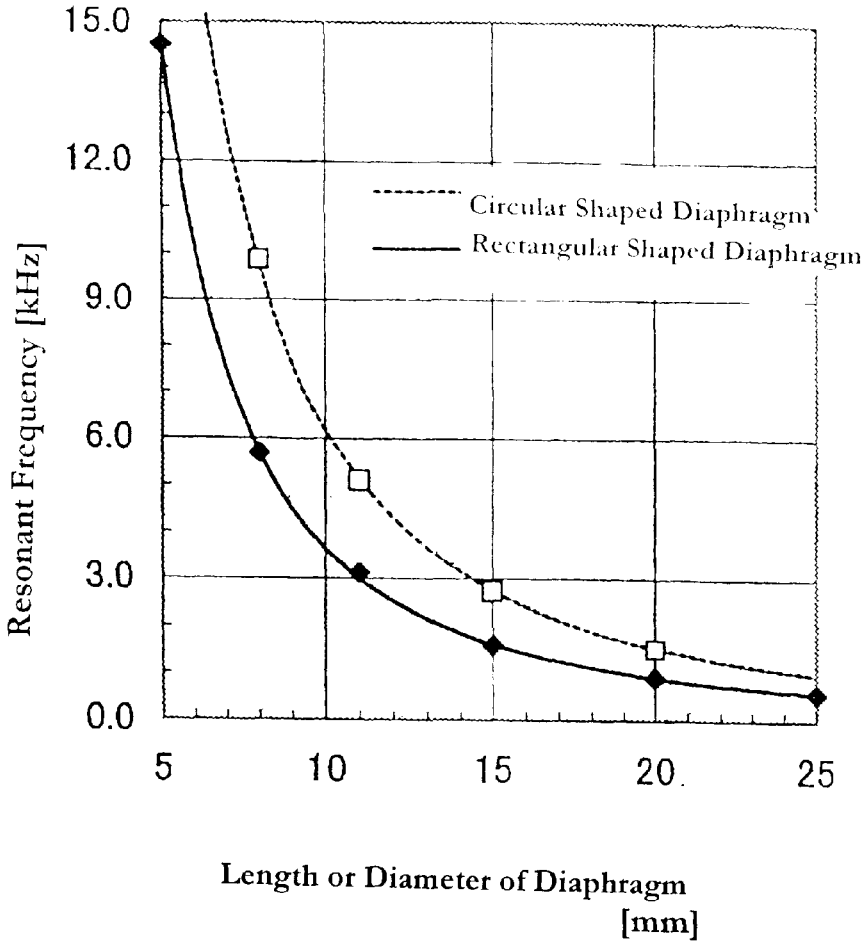
FIG. 3 is a comparative diagram showing the relationship between a circular shaped diaphragm and a rectangular shaped diaphragm.
Figure 4:
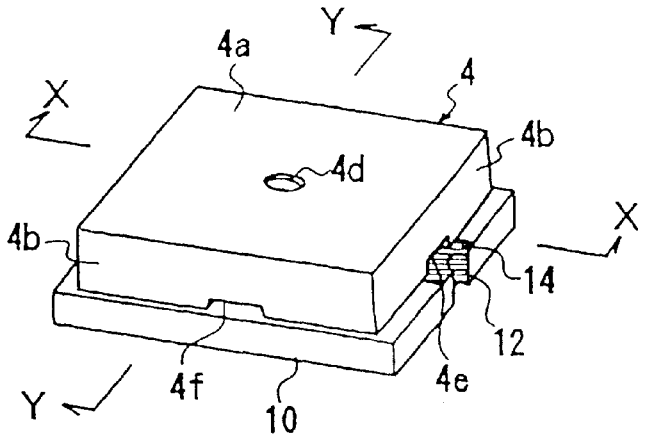
FIG. 4 is a perspective view showing a piezoelectric acoustic buzzer according to a first preferred embodiment of the present invention.

FIG. 3 is a comparative diagram showing the relationship between a circular aped diaphragm and a rectangular shaped diaphragm. As apparent from FIG. 3, the rectangular shaped diaphragm can be made to have smaller dimensions (length, diameter) compared with the circular shaped diaphragm. When the dimensions are the same, a low resonant frequency can be obtained. When the comparison is performed, a PZT material having a thickness of about 50 micrometers was used as the piezoelectric plate, and a 42Ni material having a thickness of about 50 micrometers was used as the metal plate. Further, the ratio of the length L to the width W of the rectangular shaped diaphragm was about 1.67.

FIGS. 4–7 show a piezoelectric buzzer according to a first preferred embodiment of a piezoelectric acoustic component of the present invention.

This piezoelectric buzzer preferably includes a unimorph type diaphragm 1, a cap 4 and a substrate 10.

Figure 7:
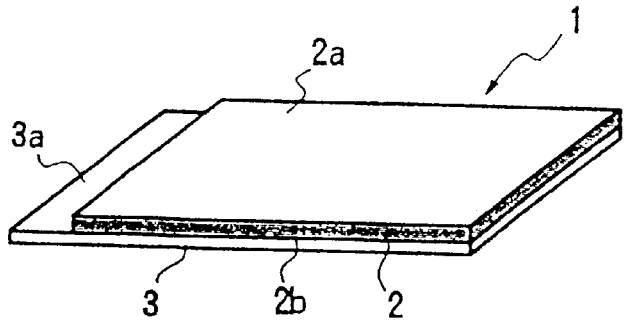
FIG. 7 is a perspective view of a diaphragm according to a preferred embodiment of the present invention.

A diaphragm 1 preferably includes a substantially rectangular shaped piezoelectric plate 2 and a substantially rectangular shaped metal plate 3, as shown in FIG. 7. Electrodes 2*a* and 2*b* defined by a thin film or a thick film are respectively disposed on the front and back surfaces of the piezoelectric plate 2, and the piezoelectric plate 2 is polarized in the thickness direction. The substantially rectangular shaped metal plate 3 is preferably constructed such that the width dimension thereof is same as that of the piezoelectric plate 2 and longitudinal dimension is slightly longer than that of the piezoelectric plate 2.

The back-side electrode 2*b* may be omitted by directly connecting the metal plate 3 to the back surface of the piezoelectric plate 2 with electroconductive glue or other suitable joining material.

In this preferred embodiment, the piezoelectric plate 2 is disposed on the metal plate 3 in such a way that respective longer edge sides of thereof are aligned with each other and a respective one of the two shorter edge sides of the plates 2, 3 are aligned with each other. That is, the piezoelectric plate 2 is disposed on the metal plate 3 leaning towards the one shorter edge side of the metal plate 3. Thereby, an exposed area 3*a* is provided around the other shorter edge side of the metal plate 3.

Piezoelectric ceramic material such as PZT may be used for the piezoelectric plate 2. Preferably the metal plate 3 is made of a material having high conductivity and high spring elasticity and even more preferably, a material having a Young's modulus close to that of the piezoelectric plate 2 is used. Therefore, phosphor bronze, 42Ni may be used, for example. In addition, when a metal plate 3 is made of 42Ni, high reliability is obtained since the thermal expansion coefficient of 42Ni is close to that of ceramic (PZT material).

The above-mentioned diaphragm 1 can be manufactured by the following processes.

First, a substantially rectangular-shaped parent substrate is punched out from a ceramic green sheet by a punching die, and electrode formation and polarization are performed on this parent substrate.

Next, the parent substrate is bonded to the mother plate of a metal plate preferably via electroconductive glue or other suitable joining material.

Next, the parent substrate and the mother metal plate which are bonded to each other are cut to have a substantially rectangular shape with a cut line in the X and Y directions using a dicer or other suitable cutting apparatus, and the diaphragm is thus obtained.

Thus, material efficiency and production efficiency are greatly improved by using the substantially rectangular shaped metal plate 3 and the substantially rectangular shaped piezoelectric board 2. Thereby, the installation cost is also greatly reduced.

The above-mentioned diaphragm 1 is contained inside of the cap 4 which is flipped over, and the shorter edge sides thereof are fixed.

The cap 4 is preferably made of insulating material such as ceramics or resin, and preferably have a box shape constituted by an upper wall 4*a* and four side walls 4*b*.

A pair of support members 4*c* which support the both ends of the diaphragm 1 are respectively integrally arranged with the cap 4 inside of two of the four side walls 4*b* arranged opposite to each other.

The support member 4*c* is made as small as possible to obtain higher sound pressure. This is because high sound pressure allows the resonance frequency to be low.

When the cap 4 is made of resin, heat-resistance resin such as LCP (liquid crystal polymer), SPS (syndiotactic polystyrene), PPS (polyphenylene sulphide), or epoxy, is preferable.

A sound-emission hole 4*d* is provided at approximately the center section of the upper wall 4*a*. A pair of notches 4*e* are provided on the edge of the pair of side walls 4*b* at an opening side of the cap 4. Further, a damping hole 4*f* is provided on the edge of the remaining one side wall 4*b* at the opening side of the cap 4.

Figure 5:
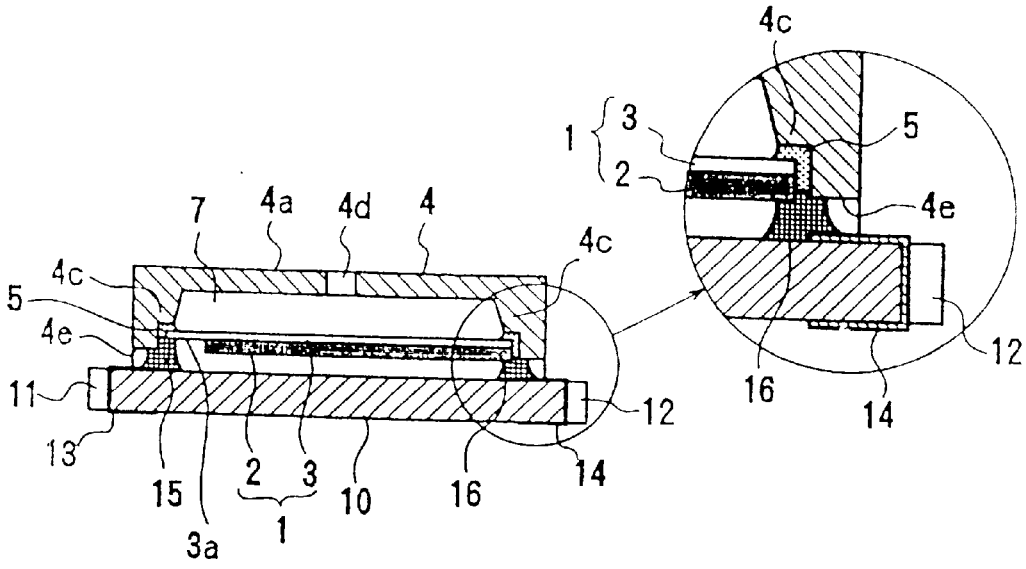
FIG. 5 is a sectional view along line X—X of FIG. 4.

A diaphragm 1 is contained inside of the cap 4 and arranged so that the metal plate 3 opposes the upper wall 4*a*, as shown in FIG. 5. A pair of the shorter edge sides of the diaphragm 1 are disposed at the pair of support members 4*c* and fixed by adhesive agent 5, respectively. Well-known insulating adhesive agents such as an epoxy group, a urethane group, and a silicone group may be used as the adhesive agent 5.

In the above described state, slight gaps are defined between each of the pair longer edge sides of the diaphragm 1 and the cap 4. The gaps are sealed by the elastic sealing materials 6 such as silicone rubber. Thereby, an acoustic space 7 is provided between diaphragm 1 and the upper wall 4*a* of the cap 4.

After fixing the diaphragm 1 to the cap 4 as mentioned above, the cap 4 is bonded to the substrate 10. The substrate 10 preferably has a substantially rectangular plate shape with insulating material, such as ceramics or resin. When using resin, heat-resistance resin, such as LCP, SPS, PPS or epoxy (including glass epoxy) may be used.

The electrode sections 13 and 14 are respectively provided at a pair of the shorter edge sides of the substrate 10. The electrode section 13 and 14 are provided for external connection and extending from the front surface to the back surface via the through-hole grooves 11 and 12.

An electrically-conductive paste 15 is provided at one of the pair of notches 4*e* i.e., on the exposed area 3*a* of the metal plate 3. An electrically-conductive paste 16 is provided at the other of the pair of notches 4*e* i.e., on the surface electrode 12*a*.

Figure 6:
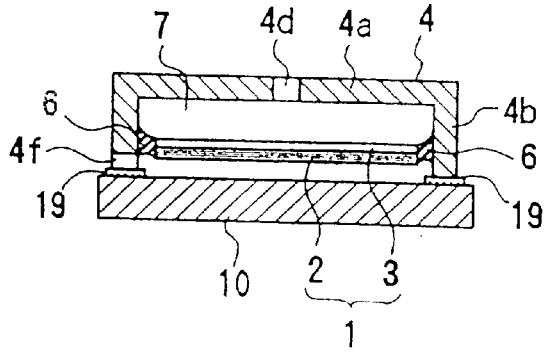
FIG. 6 is a sectional view along line Y—Y of FIG. 4.

As shown in FIG. 6, the opening edge of the cap 4 is bonded to the substrate 10 preferably by an insulating adhesive agent 19. The insulating adhesive agent 19 may provided by transferring on the opening edge of the cap 4 or the cap bonding section of the substrate 10.

In this case, the exposed area 3*a* of the metal plate 3 is electrically connected to an electrode section 13 of the substrate 10 via the electrically-conductive paste 15. The surface electrode 12*a* is electrically connected to an electrode section 14 of the substrate 10 via the electrically-conductive paste 16.

A surface mounting type piezoelectric acoustic component is obtained by heat-hardening or natural-hardening of the electrically-conductive pastes 15 and 16 and the insulating adhesive agent 19 in the above described state.

When a predetermined frequency signal (an AC signal or square-wave signal) is applied between the electrode sections 13 and 14, the predetermined buzzer sound can be generated. This is because the pair of the shorter edge sides of the diaphragm 1 are respectively fixed to the pair of the support members 4*c* of the cap 4, the pair of the longer edge sides of the diaphragm 1 are maintained in a state of being freely displaceable by the elastic sealing material 6. As a result, the diaphragm 1 is vibrated in a longitudinal bending mode with the pair of the shorter edge sides of the diaphragm 1 functioning as fulcrums.

The buzzer sound is emitted from the sound-emission hole 4*d* of the cap 4 to the exterior.

In the above-described preferred embodiment, the diaphragm 1 is fixed so that the metal plate 3 of the diaphragm 1 faces the upper wall 4*a* side of the cap 4. In other words, the diaphragm 1 is fixed so that the exposed area 3*a* of the metal plate 3 and the surface electrode 12*a* face the substrate 10. As a result, the connection between the exposed area 3*a* and the electrode section 13 and the connection between the surface electrode 12*a* and the electrode section 14 are easily obtained by using the electrically-conductive pastes 15 and 16.

In the above-described preferred embodiment, the pair of the shorter edge sides of the diaphragm 1 are respectively fixed to the pair of the support members 4*c* of the cap 4 by the adhesive agent 5, and the pair of the longer edge sides of the diaphragm 1 are sealed by the elastic sealing material 6. However, the elastic sealing material 6 may be provided over the pair of the shorter edge sides of the diaphragm 1 which are fixed to the pair of the support members 4*c* of the cap 4.

The first reason is that there is a possibility that the electroconductive glue 16 may adhere and short-circuit with the metal plate 3 when connecting the surface electrode 2*a* of the piezoelectric plate 2 is connected to the electrode section 14 of the substrate 10 by the electroconductive glues 16 and 18. The elastic sealing material 6 is provided at the outer circumference of the metal plate 3 so as to act as an insulating film for preventing the short circuit. The second reason is that the air leakage between the front and back sides of the diaphragm 1 can be prevented by sealing the whole circumference of the diaphragm 1 with the elastic sealing material 6.

Figure 8:
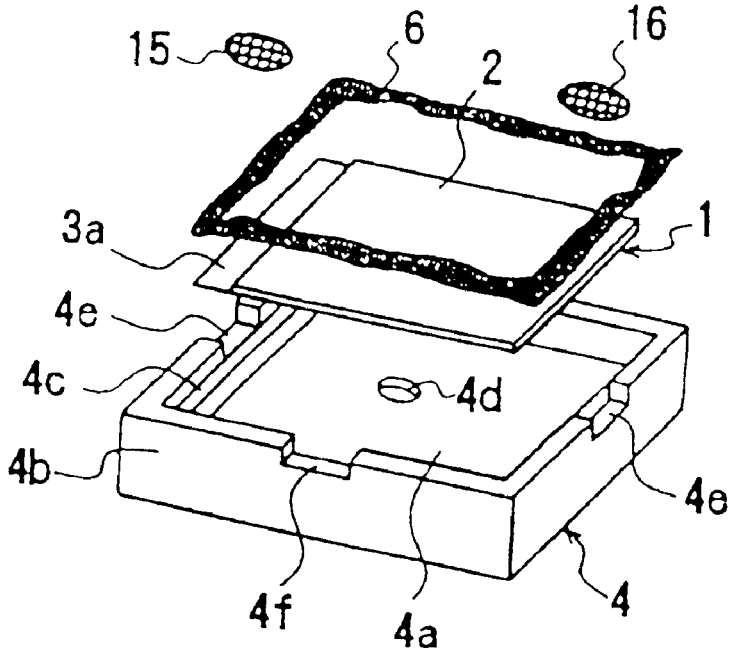
FIG. 8 is an exploded perspective view of a piezoelectric acoustic buzzer of a second preferred embodiment in which a cap and a diaphragm thereof are shown from the back-side.
Figure 9:
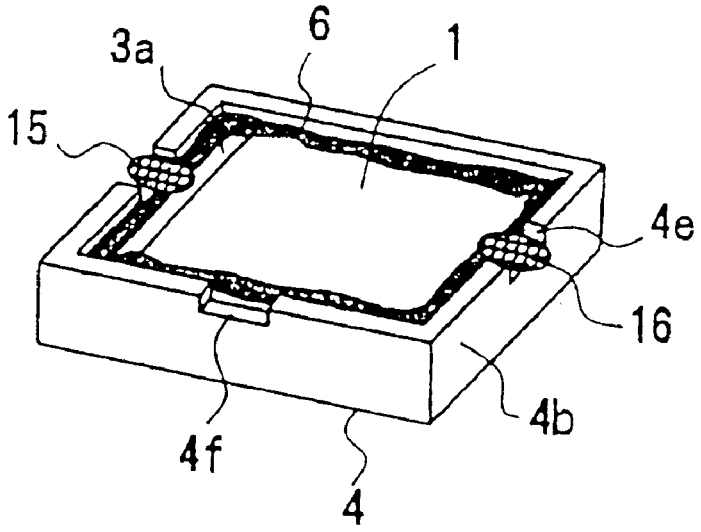
FIG. 9 is a perspective view showing the cap and the diaphragm of the piezoelectric acoustic buzzer of FIG. 8 in the finished state as viewed from the back-side.
Figure 10:
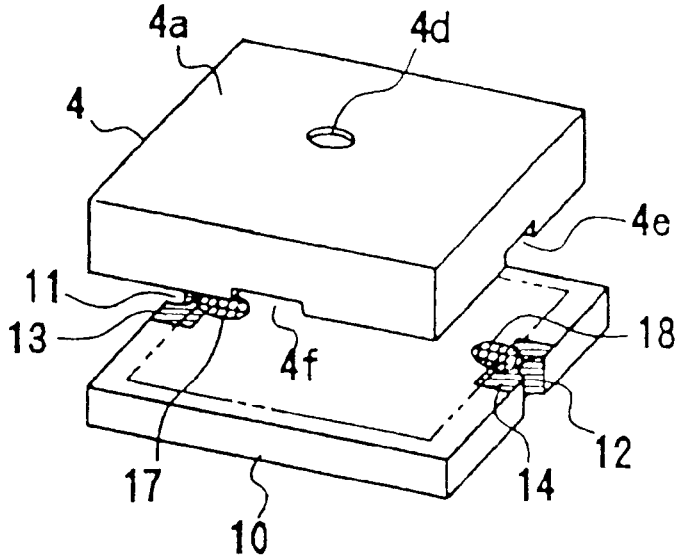
FIG. 10 is a perspective view showing a piezoelectric acoustic component of a third preferred embodiment of the present invention.

FIGS. 8 to 10 show a second preferred embodiment of the present invention. In this preferred embodiment, the diaphragm 1 is contained in the cap 4, and the four edge portions of the diaphragm 1 are sealed by the elastic sealing material 6. In this case, the shorter edge sides of the diaphragm 1 are fixed to the support members 4*c* by the elastic sealing material 6, not by the adhesive agent 5. Therefore, the restraint at the shorter edge sides of the diaphragm 1 becomes weak compared with the first preferred embodiment, and the amount of displacement of diaphragm 1 is increased. Accordingly, the sound pressure is greatly improved.

Further, in this preferred embodiment, the electrically-conductive pastes 15 and 16 are applied at the shorter edge side of the diaphragm 1, and the same type electrically-conductive pastes 17 and 18 respectively opposed to the electrically-conductive pastes 15 and 16 are applied over the electrode section 13 and 14 of the substrate 10. Accordingly, the electrical connection between the diaphragm 1 and the electrode sections 13 and 14 of the substrate 10 is achieved reliably when the cap 4 is bonded to the substrate 10. Moreover, it is not necessary to fix the cap 4 to the substrate 10 before hardening of the electrically-conductive pastes 15 and 16. It is possible to bond the cap 4 to the substrate 10 after applying the electrically-conductive pastes 15 and 16 to the diaphragm 1 and hardening them.

Figure 11:
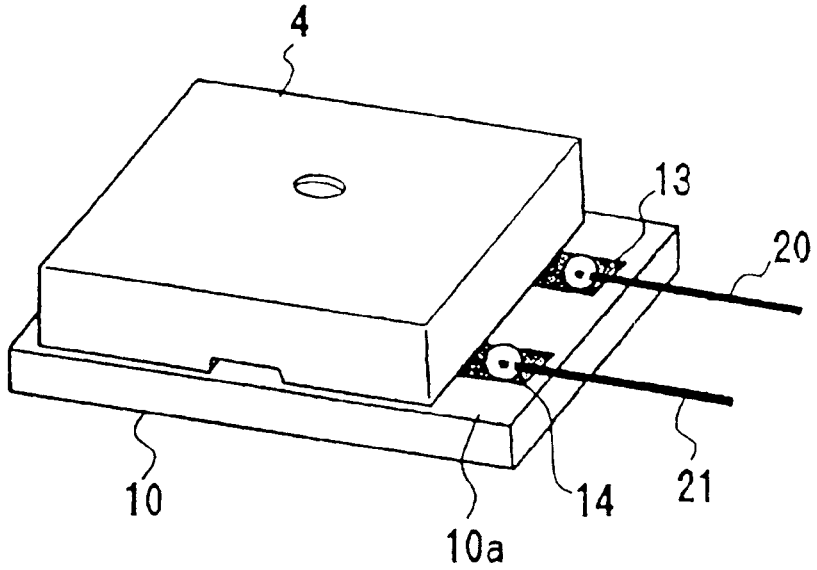
FIG. 11 is a perspective view showing a piezoelectric acoustic component of a third preferred embodiment of the present invention.
Figure 12:
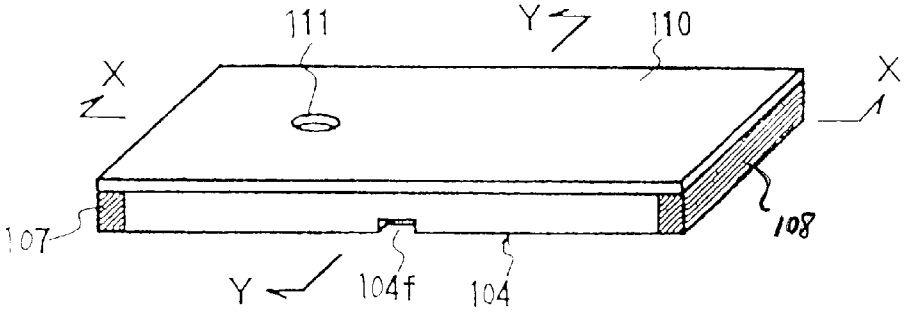
FIG. 12 is a perspective view showing a piezoelectric acoustic buzzer of a fourth preferred embodiment of the present invention.

FIG. 11 shows a third preferred embodiment of the present invention, in which the piezoelectric acoustic component is constituted as a lead type component.

In this preferred embodiment, the substrate 10 is extended in the longitudinal direction to have an extended portion 10*a*. The two electrode sections 13 and 14 are extended from the bonding portion of the cap 4 to the exterior so as to be exposed on the extended portion 10*a*. The lead terminals 20 and 21 are respectively connected to these electrode sections 13 and 14 by soldering or some other joining process.

In this case, the diaphragm 1 and the cap 4 which are preferably the same as those shown in FIGS. 4 to 10. By only changing the shape of the substrate 10 and the electrode sections 13 and 14, a piezoelectric acoustic component of a lead type can be easily obtained. Further, since a mounting process by reflow soldering is not performed, a low heat-resistant material may be used for the cap 4 and the substrate 10.

In the above described first, second and third preferred embodiments, the cap 4 in which one diaphragm 1 is fixed is bonded on the single substrate 10. However, it is possible to have a plurality of spaces in the cap 4 by providing a partition wall or other suitable separating structure, and fix the plurality of the diaphragms 1 which have different resonant frequencies in the plurality of spaces, respectively, and then bonding the cap 4 and the plurality of the diaphragms 1 on single substrate 10. In this case, different sounds can be generated from each of the diaphragms 1 if individual electrode sections corresponding to the respective diaphragms 1 are provided on the substrate 10 and connected to the respective diaphragms individually.

In addition, the shape of the metal plate and the piezoelectric plate is not restricted to substantially rectangular and instead, the shape may also be substantially square.

Further, in the above described first, second and third preferred embodiments, the diaphragm of a unimorph type in which a piezoelectric plate is disposed on one side of a metal plate is preferably used. However, the diaphragm of a bimorph type in which a pair of piezoelectric plates are disposed on both sides of a metal plate can be used as well.

Furthermore, the electroconductive glue (electrically-conductive paste) is preferably used for the connection between the metal plate and the first electrode section, and the connection between the other surface electrode of the piezoelectric plate and the second electrode section. However, other means (solder, electrically-conductive wire, etc.) can be used for achieving the connection as well.

The present invention is applicable to a piezoelectric earphone, a piezoelectric speaker, a piezoelectric sounding device, a ringer, or other such apparatus in addition to a piezoelectric buzzer.

FIGS. 12–15 show a piezoelectric buzzer which is the fourth preferred embodiment of a piezoelectric acoustic component of the present invention.

This piezoelectric buzzer includes a unimorph type diaphragm 101, a cap 104 and a substrate 110.

Figure 16:
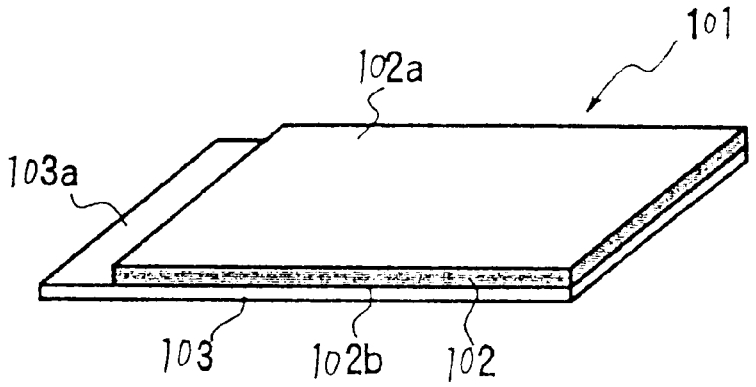
FIG. 16 is a perspective view of a diaphragm according to a preferred embodiment of the present invention.

A diaphragm 101 preferably includes a substantially rectangular shaped piezoelectric plate 102 and a substantially rectangular shaped metal plate 103, as shown in FIG. 16. Electrodes 102*a* and 102*b* made of a thin film or a thick film are respectively disposed on the front and back surfaces of the piezoelectric plate 102, and the piezoelectric plate 102 is polarized in the thickness direction. The substantially rectangular shaped metal plate 103 is constructed such that the width dimension thereof is same as that of the piezoelectric plate 102 and the longitudinal dimension is slightly longer than that of the piezoelectric plate 102.

The back-side electrode 102*b* may be omitted by directly connecting the metal plate 103 to the back surface of the piezoelectric plate 102 via electroconductive glue or other suitable bonding material.

In this preferred embodiment, the piezoelectric plate 102 is disposed on the metal plate 103 in such a way that respective longer edge sides of them are aligned to each other and a respective one of the two shorter edge sides of them are aligned to each other. That is, the piezoelectric plate 102 is disposed on the metal plate 103 leaning towards the one shorter edge side of the metal plate 103. Thereby, an exposed area 103*a* is provided around the other shorter edge side of the metal plate 103.

Piezoelectric ceramic material such as PZT may be used for the piezoelectric plate 102. Preferably the metal plate 103 is made of a material having high conductivity and high spring elasticity and even more preferably, a material having a Young's modulus close to that of the piezoelectric plate 102 is used. Therefore, phosphor bronze, 42Ni, may be used, for example. In addition, when a metal plate 103 is made of 42Ni, the high reliability is obtained since the thermal expansion coefficient of 42Ni is close to that of ceramic (PZT material).

The above-mentioned diaphragm 101 can be manufactured by the following processes.

First, a substantially rectangular parent substrate is punched out from a ceramic green sheet by a punching die, and electrode formation and polarization are performed on this parent substrate.

Next, the parent substrate is bonded to the mother plate of a metal plate by the electroconductive glue or other bonding material.

Next, the parent substrate and the mother metal plate which are bonded to each other are cut to have a substantially rectangular shape with a cut line in the X and Y directions using a dicer or other cutting apparatus.

Thus, material efficiency and production efficiency are greatly improved by using the substantially rectangular shaped metal plate 103 and the substantially rectangular shaped piezoelectric board 102. Thereby, the installation costs are also greatly decreased.

The above-mentioned diaphragm 101 is contained inside the case 104, and the shorter edge sides thereof are fixed.

The case 104 is preferably made of insulating material such as ceramics or resin, and preferably has a substantially rectangular box shape constituted by a bottom wall 104*a* and four side walls 104*b*.

A pair of support members 104*d* which support both ends of the diaphragm 101 are respectively integral with the case 104 inside of the two shorter side walls 104*b* opposed each other.

The support member 104*d* is made as small as possible to obtain higher sound pressure. This is because high sound pressure allows the resonance frequency to be low.

When the case 104 is made of resin, heat-resistance resin such as LCP (liquid crystal polymer), SPS (syndiotactic polystyrene), PPS (polyphenylene sulphide), or epoxy, is preferable.

A pair of recess portions 104*e* are provided at the inside of the side wall 104*b* which constitute the support members 104*d*. The electroconductive films 107 and 108 are arranged to extend from the inside of the recess portions 104*e* to the bottom surface of the side wall 104*b* via upper and external surfaces of the side wall 104*b*. Further, a damping hole 104*f* is provided at the approximate center of the boundary portion of the longer side wall 104*c* and the bottom wall 104*a*.

Figure 13:
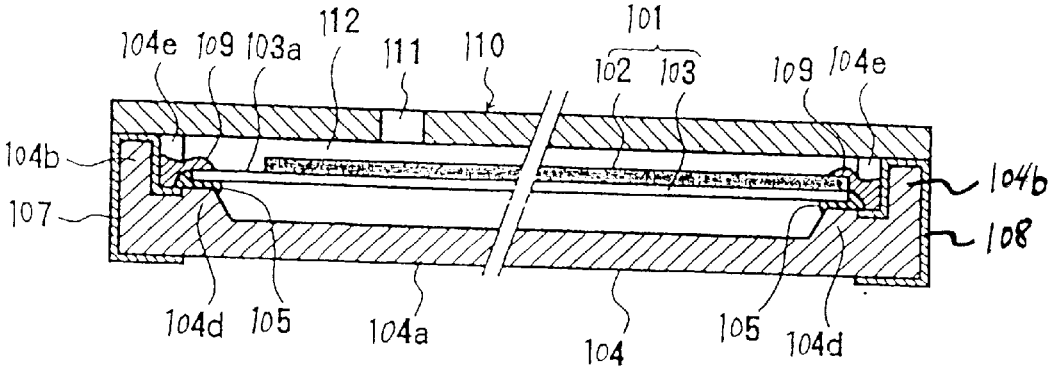
FIG. 13 is a sectional view along line X—X of FIG. 12.
Figure 14:
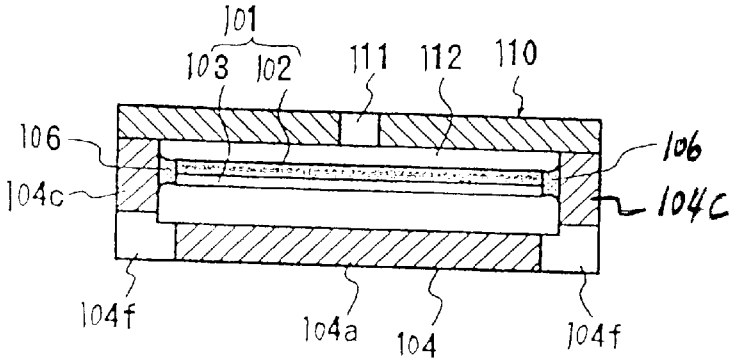
FIG. 14 is a sectional view along line Y—Y of FIG. 12.
Figure 15:
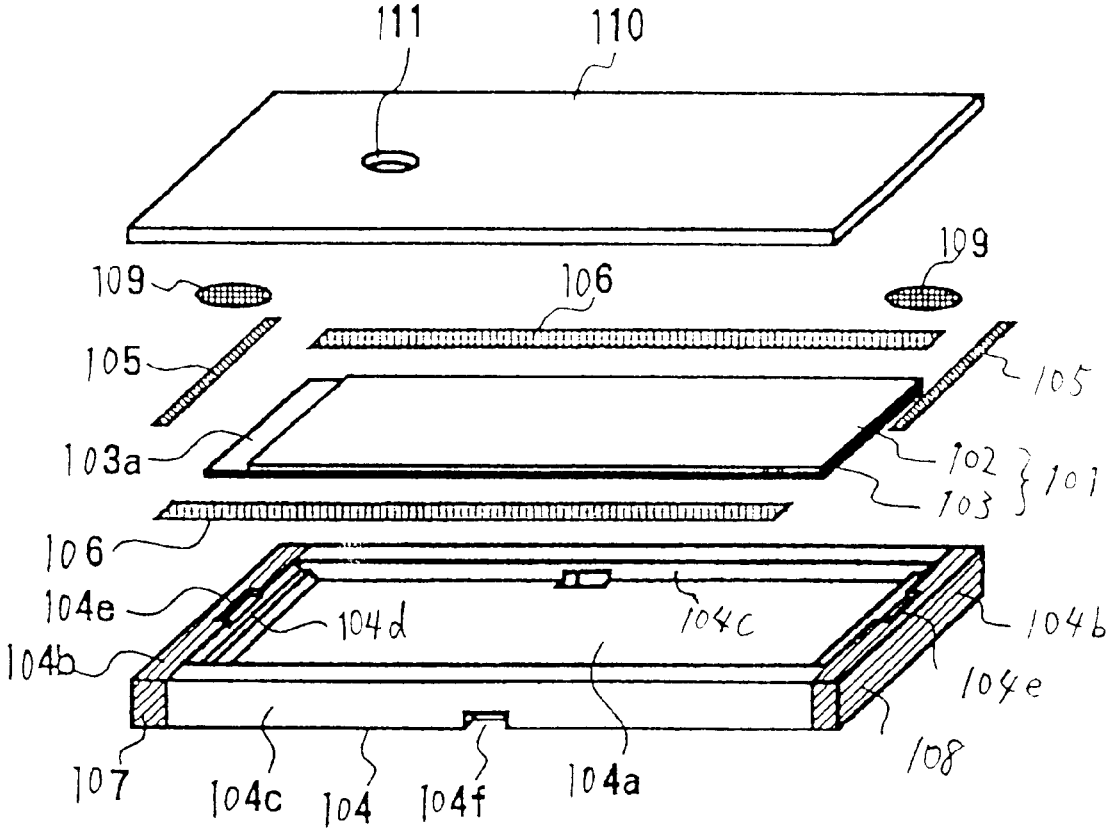
FIG. 15 is an exploded perspective view of the piezoelectric acoustic buzzer shown in FIG. 12.

A diaphragm 101 is contained inside of the case 104 so that the metal plate 103 opposes the bottom wall 104*a*, as shown in FIG. 13. A pair of the shorter edge sides of the diaphragm 101 are disposed at the pair of support members 104*d* and fixed by adhesive agent 105, respectively. Well-known insulating adhesive agents such as an epoxy group, a urethane group, and a silicone group may be used as the adhesive agent 105.

In the above described state, slight gaps are defined between each of the pair longer edge sides of the diaphragm 101 and the case 104. The gaps are sealed by the elastic sealing materials 106 such as silicone rubber.

After jointing the diaphragm 101 to the case 104 as described above, electroconductive paste 109 is applied between the shorter edge sides of the diaphragm 101 and the recess portions 104*e*, and the exposed area 103*a* of the metal plate 103 is electrically connected to the electroconductive film 107 and the electrode 102*a* disposed on the front surface of the piezoelectric plate 102 is electrically connected to the electroconductive film 108.

After fixing the diaphragm 101 to the case 104 as mentioned above, a lid 110 including a sound emission hole 111 is bonded to the case 104. The lid 110 preferably has a substantially rectangular plate shape including insulating material, such as ceramics or resin. When using resin, heat-resistance resin, such as LCP, SPS, PPS or epoxy (including glass epoxy) which is used for the case 104 may be used. By bonding the lid 110 to the case 104, a sound space 112 is defined between the lid 110 and the diaphragm 101 to thereby produce a surface mounting type piezoelectric acoustic component.

When a predetermined frequency signal (an AC signal or square-wave signal) is applied between the electrode sections 107 and 108 provided at the case 104, the predetermined buzzer sound can be generated. This is because the pair of the shorter edge sides of the diaphragm 101 are respectively fixed to the pair of the support members 104*d* of the case 104, the pair of the longer edge sides of the diaphragm 101 are maintained in a state of being freely displaceable by the elastic sealing material 106, and thereby the diaphragm 101 is vibrated in a longitudinal bending mode with the pair of the shorter edge sides of the diaphragm 101 functioning as fulcrums.

The buzzer sound is emitted from the sound-emission hole 111 of the lid 110 to the exterior of the component.

In the above-mentioned preferred embodiment, the diaphragm 101 is fixed so that the metal plate 103 of the diaphragm 101 faces the bottom wall 104*a* side of the case 104. It is possible to fix the diaphragm 101 so that the piezoelectric plate 102 faces the bottom wall 104*a* of the case 4. As a result, the electrode 102*a* of the piezoelectric plate 102 and the exposed area 103*a* of the metal plate 103 expose to the upper side. Therefore, the connection between the exposed area 103*a* and the electrode section 107 and the connection between the electrode 112*a* and the electrode section 108 are easily obtained by using the electrically-conductive paste 109.

In the above-described preferred embodiment, the pair of the shorter edge sides of the diaphragm 101 are respectively fixed to the pair of the support members 104*d* of the case 4 by the adhesive agent 105, and the pair of the longer edge sides of the diaphragm 101 are sealed by the elastic sealing material 106. However, the elastic sealing material 106 may be provided over the pair of the shorter edge sides of the diaphragm 101 which are fixed to the pair of the support members 104*d* of the case 104. The first reason is that there is a possibility that the electroconductive paste 109 may adhere and short-circuit with the metal plate 103 when connecting the electrode 102*a* of the piezoelectric plate 102 to the electrode section 108 via the electroconductive paste 109. The elastic sealing material 106 is provided at the outer circumference of the metal plate 103 as an insulating film for preventing the short circuit. The second reason is that the air leakage between the front and back sides of the diaphragm 101 can be prevented by sealing the whole outer circumference of the diaphragm 101 with the elastic sealing material 106.

Figure 17:
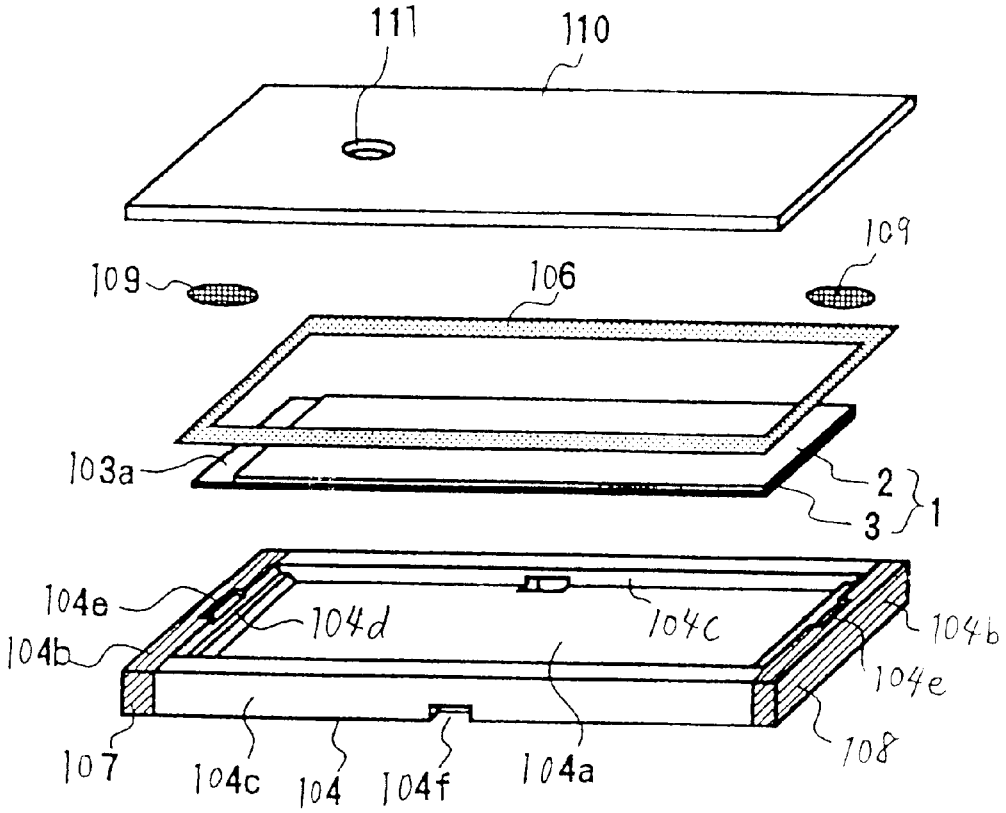
FIG. 17 is an exploded perspective view of a piezoelectric acoustic component of a fifth preferred embodiment of the present invention.
Figure 18:
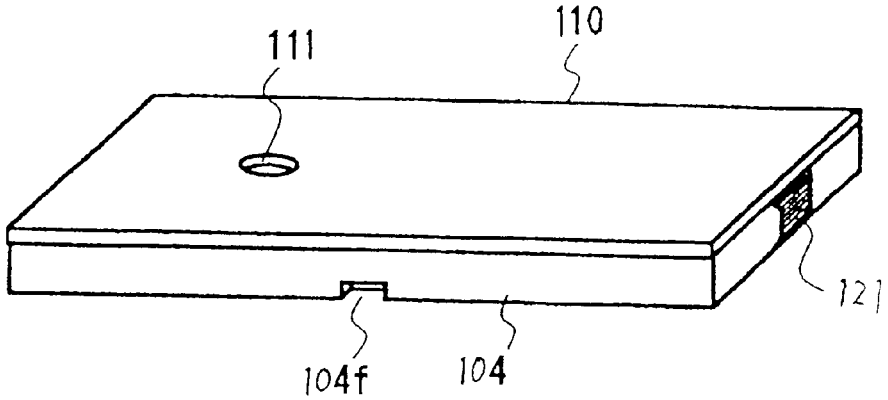
FIG. 18 is a perspective view showing a piezoelectric acoustic component of a sixth preferred embodiment of the present invention.
Figure 19:
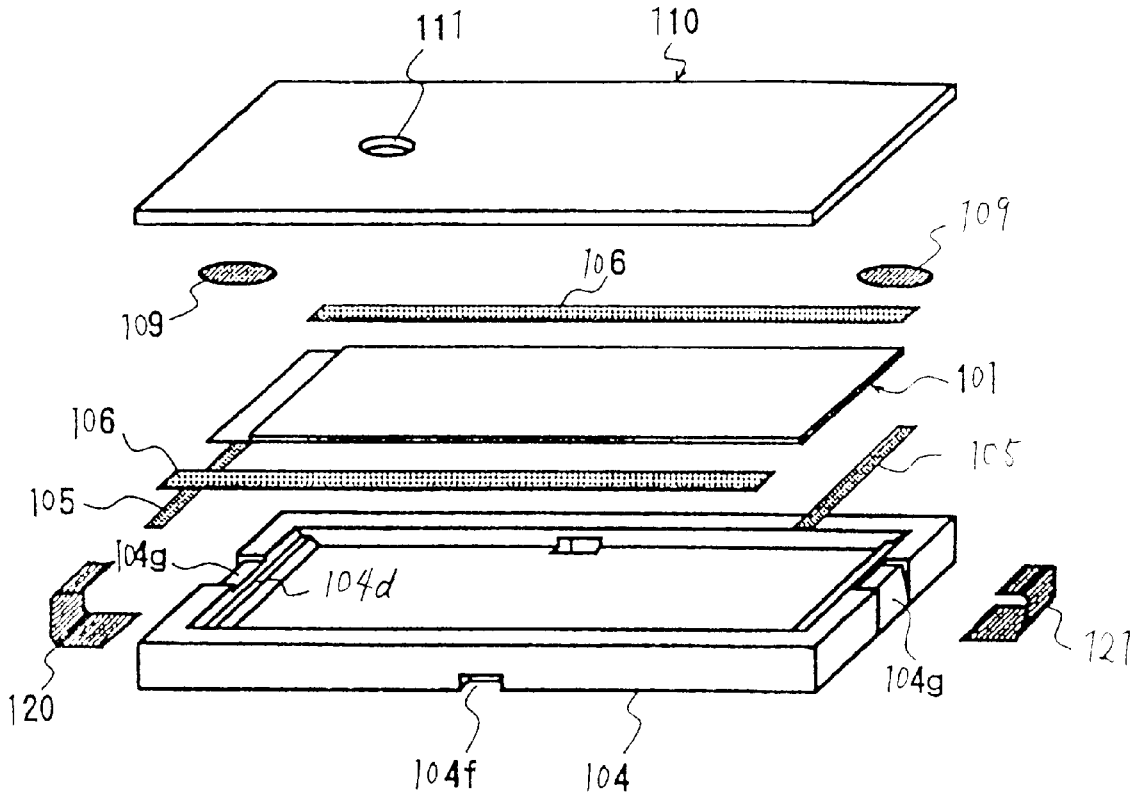
FIG. 19 is an exploded perspective view of the piezoelectric acoustic component shown in FIG. 18.
Figure 20:
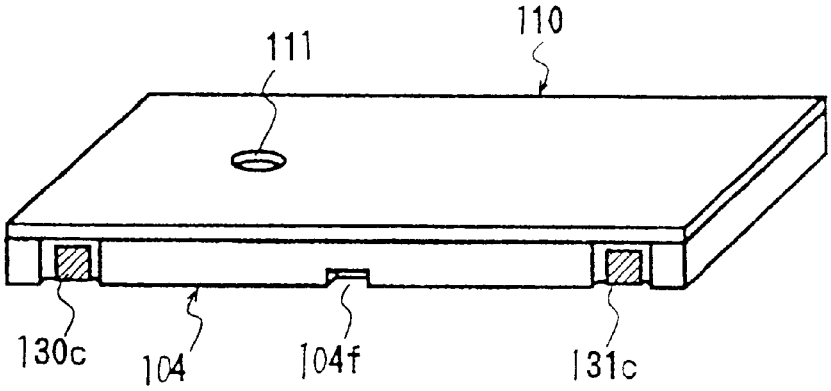
FIG. 20 is a perspective view showing a piezoelectric acoustic component of a seventh preferred embodiment of the present invention.
Figure 21:
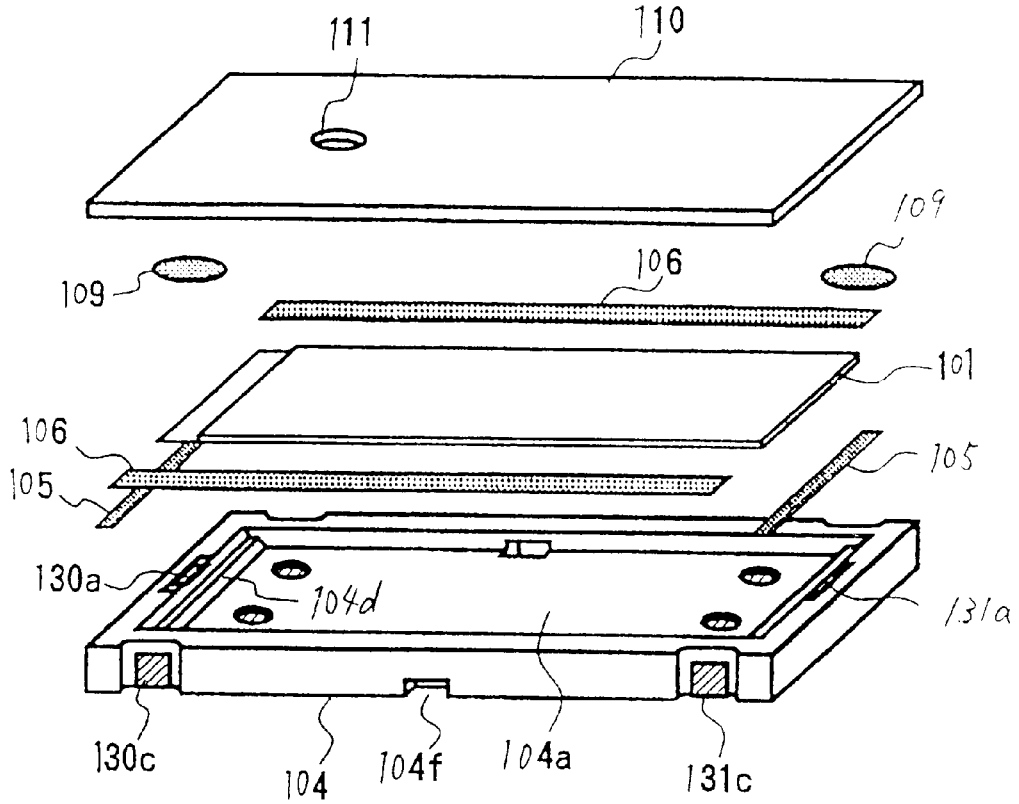
FIG. 21 is a exploded perspective view of the piezoelectric acoustic component shown in FIG. 20.
Figure 22:
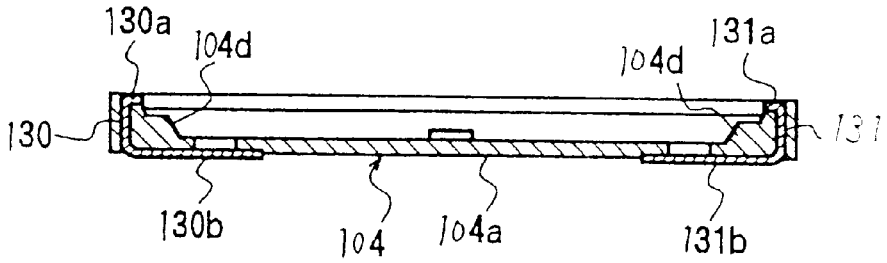
FIG. 22 is a sectional view of the insulating case of the piezoelectric acoustic component shown in FIG. 20.
Figure 23:
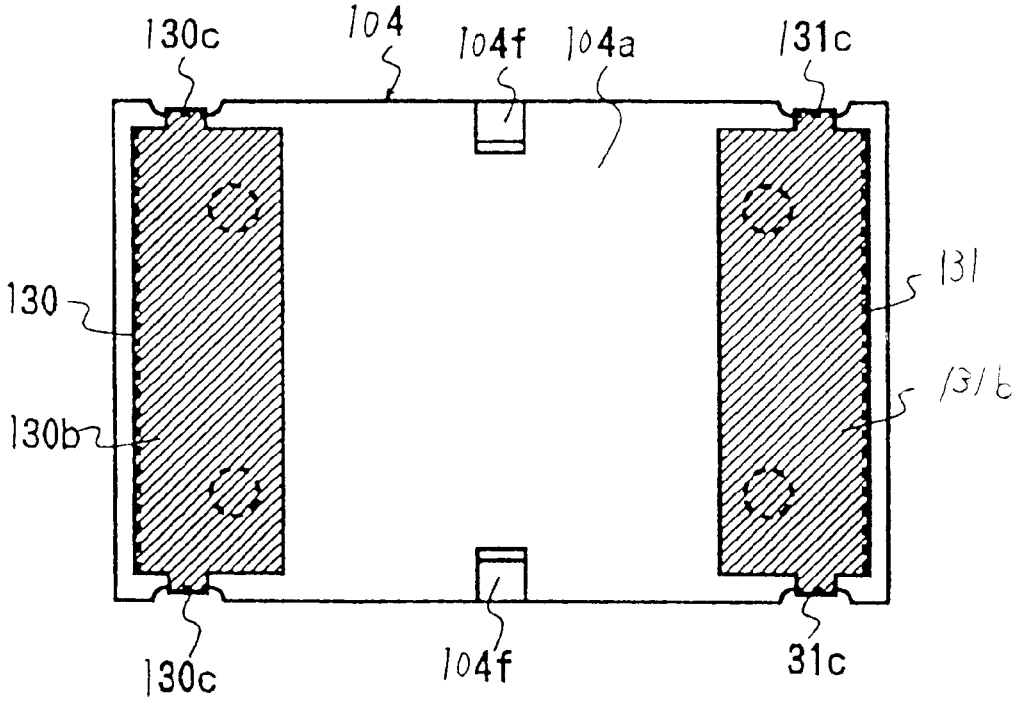
FIG. 23 is a back view of the insulating case of the piezoelectric acoustic component shown in FIG. 20.

FIG. 17 shows a fifth preferred embodiment of the present invention. In this preferred embodiment, the diaphragm 101 is contained in the case 104, and the four edge portions of the diaphragm 101 are bonded and sealed by the elastic sealing material 106. In this case, the shorter edge sides of the diaphragm 101 are fixed to the support members 104*d* by the elastic sealing material 106, not by the adhesive agent 105. Therefore, the restraint at the shorter edge sides of the diaphragm 101 becomes weak compared with the fourth preferred embodiment, and the amount of displacement of diaphragm 101 is increased. Accordingly, the sound pressure is greatly improved. It is noted that reference numerals similar to the fourth preferred embodiment indicate like elements to avoid duplicative description FIGS. 18 and 19 show a sixth preferred embodiment of the present invention. In this preferred embodiment, the electrode section provided on the case 104 is constituted by a metal terminal. It is noted that reference numerals similar to the fourth preferred embodiment indicate like elements to avoid duplicative description.

The metal terminals 120 and 121 are bent to have a substantially U-shaped configuration and fit in the groove 104*g* formed at the shorter side wall 104*b* of the case 104. The metal terminals 120 and 121 are fixed by adhesive, crimping, welding, or other suitable means. Each of one ends of the metal terminals 120 and 121 are extended to the inside of the side wall 104*b* and the each of the other ends thereof are extended to the bottom surface of the case 104. The exposed area 103*a* of the metal plate 103 and the metal terminal 120 are electrically connected by applying an electroconductive paste 109 therebetween and the electrode 102*a* and the metal terminal 121 are electrically connected by applying an electroconductive paste 109 therebetween.

FIGS. 20 to 23 show a seventh preferred embodiment of the present invention. In this preferred embodiment, the electrode section provided on the case 104 is defined an inserting terminal. It is noted that reference numerals similar to the fourth preferred embodiment indicate like elements to avoid duplicative description.

Each of one ends 130*a* and 131*a* of the inserting terminals 130 and 131 are exposed at the inside of the shorter side wall 104*b* and the each of the other ends 130*b* and 131*b* thereof are extended to the bottom surface of the case 104. Both ends 130*c* and 131*c* of the other ends 130*b* and 131*b* in the width direction are extended to the longer side wall 104*c* of the case 104. Further, the exposed area 103*a* of the metal plate 103 and the inserting terminal 130 are electrically connected by applying an electroconductive paste 109 therebetween and the electrode 102*a* of the piezoelectric plate 102 and the inserting terminal 131 are electrically connected by applying an electroconductive paste 109 therebetween.

In the above described fifth, sixth and seventh preferred embodiments, the case 104 in which one diaphragm 101 is fixed is shown. However, it is possible to have a plurality of spaces in the case 104 by providing a partition wall or other separating structure or element, and fix the plurality of the diaphragms 101 which have different resonant frequencies in the plurality of spaces respectively. In this case, different sounds can be generated from each of the diaphragms 101 if individual electrode sections corresponding to the respective diaphragms 101 are connected to the respective diaphragms 101 individually.

In addition, the shape of the metal plate and the piezoelectric plate is not restricted to be only substantially rectangular. The shape of the metal plate and the piezoelectric plate may also be substantially square.

Further, in the above described fifth, sixth and seventh preferred embodiments, the diaphragm of a unimorph type in which a piezoelectric plate is disposed on one side of a metal plate is preferably used. However, the diaphragm of bimorph type in which a pair of piezoelectric plates are disposed on both sides of a metal plate can be used as well.

Furthermore, the electroconductive glue (electrically-conductive paste) is preferably used for the connection between the metal plate and the first electrode section, and the connection between the other surface electrode of the piezoelectric plate and the second electrode section. However, other means (solder, electrically-conductive wire, etc.) can be used for the connection as well.

The present invention is applicable to a piezoelectric earphone, a piezoelectric speaker, a piezoelectric sounding device, a ringer, and other similar components and apparatuses, in addition to a piezoelectric buzzer.

While the invention has been particularly shown and described with reference to preferred embodiments thereof, it will be understood by those skilled in the art that the forgoing and other changes in form and details may be made therein without departing from the spirit of the invention.

What is claimed is:

1. A piezoelectric acoustic component, comprising:

a diaphragm including a piezoelectric plate including front and back surfaces, an electrode disposed on the front surface, a metal plate bonded to the back surface of the piezoelectric plate directly or via an electrode disposed on the back surface of the piezoelectric plate;

an insulating cap including an upper wall, four side walls extended from the upper wall, and a pair of support members arranged to support the diaphragm at the inside of two of the four side walls which are opposite to each other; and a plate shaped substrate having a first electrode section and a second electrode section; wherein the diaphragm is located in the insulating cap, only two of the four side edges of the diaphragm that are disposed opposite to each other are fixed to the pair of support members, a gap is defined between the other two of the four side edges of the diaphragm and the cap, an elastic sealing material is arranged to seal the gap between the other two of the four side edges of the diaphragm and the cap, an acoustic space is defined between the diaphragm and the upper wall of the insulating cap, an opening edge of the four side walls of the insulating cap is bonded to the substrate, the metal plate is electrically connected to the first electrode section and the electrode disposed on the front surface of the piezoelectric plate is electrically connected to the second electrode section.

2. The piezoelectric acoustic component according to claim 1, wherein the piezoelectric plate is disposed on the metal plate in such a way that respective longer edge sides of the piezoelectric plate and the metal plate are aligned with each other and a respective one of the two shorter edge sides of the piezoelectric plate and the metal plate are aligned with each other so that the piezoelectric plate is disposed on the metal plate leaning towards the one shorter edge side of the metal plate at which the metal plate is supported by the support member of the insulating cap;

an exposed area is provided around the other shorter edge side of the metal plate; and the diaphragm is fixed to the support members of the insulating cap so that the metal plate opposes the upper wall of the insulating cap.

3. The piezoelectric acoustic component according to claim 1, wherein the metal plate is connected to the first electrode section by electroconductive glue and the electrode disposed on the front surface of the piezoelectric plate is connected to the second electrode section by electroconductive glue.

4. The piezoelectric acoustic component according to claim 1, wherein the elastic sealing material is made of an insulating material and the elastic sealing material is provided at all of the four side edges of the diaphragm.

5. The piezoelectric acoustic component according to claim 1, wherein the piezoelectric plate is substantially rectangular.

6. The piezoelectric acoustic component according to claim 1, wherein the metal plate is substantially rectangular.

7. The piezoelectric acoustic component according to claim 1, further comprising one of an adhesive agent and an elastic sealing material arranged to fix the two of the four side edges of the diaphragm that are disposed opposite to each other to the pair of support members.

8. The piezoelectric acoustic component according to claim 1, wherein the diaphragm is one of a unimorph type and a bimorph type.

9. The piezoelectric acoustic component according to claim 1, wherein the piezoelectric acoustic component is one of a piezoelectric buzzer, a piezoelectric earphone, a piezoelectric speaker, a piezoelectric sounding device, and a ringer.

10. A piezoelectric acoustic component, comprising:

a diaphragm including a piezoelectric plate including front and back surfaces, an electrode disposed on the front surface, a metal plate bonded to the back surface of the piezoelectric plate directly or via an electrode disposed on the back surface of the piezoelectric plate;

an insulating cap including an upper wall, four side walls extended from the upper wall, and a pair of support members arranged to support the diaphragm at the inside of two of the four side walls which are opposite to each other; and a lid including a sound emission hole; wherein the diaphragm is located in the insulating cap, only two of the four side edges of the diaphragm that are disposed opposite to each other are fixed to the pair of support members, a gap is defined between the other two of the four side edges of the diaphragm and the cap, an elastic sealing material is arranged to seal the gap between the other two of the four side edges of the diaphragm and the cap, the metal plate is electrically connected to the first electrode section, the electrode disposed on the front surface of the piezoelectric plate is electrically connected to the second electrode section, and an opening edge of the insulating case is bonded to the lid.

11. The piezoelectric acoustic component according to claim 10, wherein at least one of the electrode sections includes an electrode film which is provided on the surface of the insulating case and extends from one of the support members to the bottom surface of the insulating case.

12. The piezoelectric acoustic component according to claim 10, wherein at least one of the electrode sections includes a metal terminal which is fixed to the insulating case and extends from the support member to the bottom surface of the insulating case.

13. The piezoelectric acoustic component according to claim 10, wherein the piezoelectric plate is disposed on the metal plate in such a way that respective longer edge sides of the piezoelectric plate and the metal plate are aligned with each other and a respective one of the two shorter edge sides of the piezoelectric plate and the metal plate are aligned with each other so that the piezoelectric plate is disposed on the metal plate leaning towards the one shorter edge side of the metal plate at which the metal plate is supported by the support member of the insulating cap;

an exposed area is provided around the other shorter edge side of the metal plate; and the diaphragm is fixed to the support members of the insulating cap so that the metal plate opposes the upper wall of the insulating cap.

14. The piezoelectric acoustic component according to claim 10, wherein the metal plate is connected to the first electrode section by electroconductive glue and the electrode disposed on the front surface of the piezoelectric plate is connected to the second electrode section by electroconductive glue.

15. The piezoelectric acoustic component according to claim 10, wherein the elastic sealing material is made of an insulating material and the elastic sealing material is provided at all of the four side edges of the diaphragm.

16. The piezoelectric acoustic component according to claim 10, wherein the piezoelectric plate is substantially rectangular.

17. The piezoelectric acoustic component according to claim 10, wherein the metal plate is substantially rectangular.

18. The piezoelectric acoustic component according to claim 10, further comprising one of an adhesive agent and an elastic sealing material arranged to fix the two of the four side edges of the diaphragm that are disposed opposite to each other to the pair of support members.

19. The piezoelectric acoustic component according to claim 10, wherein the diaphram is one of a unimorph type and a bimorph type.

20. The piezoelectric acoustic component according to claim 10, wherein the piezoelectric acoustic component is one of a piezoelectric buzzer, a piezoelectric earphone, piezoelectric speaker, a piezoelectric sounding device, and a ringer.

* * * * *